US010736366B2

(12) United States Patent
Bell

(10) Patent No.: US 10,736,366 B2
(45) Date of Patent: Aug. 11, 2020

(54) BREATHABLE GARMENT

(71) Applicant: MAT PRODUCT & TECHNOLOGY, S.L.U., Terrassa (ES)

(72) Inventor: Colin Bell, Barcelona (ES)

(73) Assignee: MAT PRODUCT & TECHNOLOGY, S.L.U., Terrassa (ES)

( * ) Notice: Subject to any disclaimer, the term of this patent is extended or adjusted under 35 U.S.C. 154(b) by 572 days.

(21) Appl. No.: 15/529,546

(22) PCT Filed: Nov. 23, 2015

(86) PCT No.: PCT/ES2015/070838
§ 371 (c)(1),
(2) Date: May 25, 2017

(87) PCT Pub. No.: WO2016/083638
PCT Pub. Date: Jun. 2, 2016

(65) Prior Publication Data

US 2017/0311657 A1 Nov. 2, 2017

(30) Foreign Application Priority Data

Nov. 25, 2014 (ES) ..... 201431745

(51) Int. Cl.
*A41D 13/005* (2006.01)
*A41D 13/002* (2006.01)
(Continued)

(52) U.S. Cl.
CPC ..... *A41D 13/0051* (2013.01); *A41D 1/002* (2013.01); *A41D 13/0025* (2013.01);
(Continued)

(58) Field of Classification Search
CPC ..... A41D 13/0051; A41D 13/0053; A41D 1/002; A41D 13/0025; A41D 2600/102;
(Continued)

(56) References Cited

U.S. PATENT DOCUMENTS 2,540,547 A 2/1951 Rodert
5,320,164 A 6/1994 Szczesuil et al.
(Continued)

FOREIGN PATENT DOCUMENTS

DE 10 2011 010 119 A1 8/2012
EP 1 473 059 A2 11/2004
(Continued)

OTHER PUBLICATIONS

International Search Report for PCT/ES2015/070838 dated Apr. 21, 2016 [PCT/ISA/210].
Spanish Search Report for ES201431745 dated Feb. 17, 2016.

*Primary Examiner* — Dana Ross
*Assistant Examiner* — Joe E Mills, Jr.
(74) *Attorney, Agent, or Firm* — Sughrue Mion, PLLC

(57) ABSTRACT

A breathable garment for heating or cooling independently the body of a wearer. The breathable garment includes an inner electrically heatable substrate intended to be facing the body of the wearer in use; a forced air supply mechanism for supplying forced air into the space between the inner electrically heatable substrate and the body of the wearer; an intermediate perforated substrate; an outer waterproof, water-vapour-permeable substrate; and a mechanism for maintaining a gap between the intermediate perforated substrate and the outer substrate, making up an air chamber to allow turbulent airflow across the entire garment.

30 Claims, 3 Drawing Sheets

(51) Int. Cl.
*A41D 1/00* (2018.01)
*A41D 31/02* (2019.01)
*A41D 31/102* (2019.01)

(52) U.S. Cl.
CPC ..... *A41D 31/02* (2013.01); *A41D 31/102* (2019.02); *A41D 2600/102* (2013.01)

(58) Field of Classification Search
CPC .. A41D 31/02; A41D 31/102; A41D 2400/12; H05B 3/345; H05B 3/347; H05B 2203/036
USPC ..... 219/212, 528–529
See application file for complete search history.

(56) References Cited

U.S. PATENT DOCUMENTS

| | | | | |
|---|---|---|---|---|
| 6,565,699 | B1 | 5/2003 | Szczesuil et al. | |
| 6,823,678 | B1 | 11/2004 | Li | |
| 2006/0174392 | A1 | 8/2006 | Farnworth et al. | |
| 2013/0061366 | A1* | 3/2013 | Pezzimenti | A41D 31/02 2/69 |
| 2013/0305438 | A1* | 11/2013 | Fuhr | A41D 13/0051 2/458 |
| 2015/0374045 | A1* | 12/2015 | Codner | A41D 13/0025 2/455 |

FOREIGN PATENT DOCUMENTS

| | | | |
|---|---|---|---|
| EP | 2 803 279 | A2 | 11/2014 |
| WO | 2009/024779 | A1 | 2/2009 |
| WO | 2013/044108 | A1 | 3/2013 |
| WO | 2013/070086 | A1 | 5/2013 |

* cited by examiner

BREATHABLE GARMENT

CROSS REFERENCE TO RELATED APPLICATIONS

This application is a National Stage of International Application No. PCT/ES2015/070838, filed on Nov. 23, 2015, which claims priority from Spanish Patent Application No. P201431745, filed on Nov. 25, 2014, the contents of all of which are incorporated herein by reference in their entirety.

TECHNICAL FIELD OF THE INVENTION

The present invention relates to a breathable garment for heating or cooling independently the body of a wearer, which is particularly useful in a number of applications where both heating and cooling may be required, for example, in motor cycling and hazardous chemical workwear suits.

BACKGROUND OF THE INVENTION

Impermeable breathable membranes are known in the art and are widely used for the production of garments and other clothing. The membrane is impermeable in the sense that it resists the ingress of liquid water and wind, whilst at the same time being water-vapour-permeable, such that moisture (perspiration/sweat) given off by the wearer of a garment is able to pass through the membrane. This avoids a build up of moisture within the garment, which would otherwise lead to a clammy uncomfortable feeling. Many such types of impermeable breathable fabrics are known in the art and often include moisture vapour permeable polyurethanes and expanded polytetrafluoroethylene membranes (ePTFE).

Impermeable breathable fabrics are used in a wide variety of clothing applications. In certain applications, such as those for motor bike riders or for military use, the garments may also be worn with independent mid layer garments (heated vests) used as a means for heating the interior of the garment so as to warm the wearer. Thus, heated vests are known for motor bike riders, which comprise an outer garment layer comprising an exterior fabric, an insulation layer, a heated panel layer and a lining layer; in the order passing from the exterior of the garment to the interior. Thus, a layer of insulation lies between the impermeable breathable fabric and the heating layer, which serves to minimise heat loss, away from the wearer.

It is also known in the art to provide a garment with cooling means, whereby the wearer of the garment can be cooled down. Cooling means are particularly desirable in the situation where the garment itself cannot or should not be removed (for example, if it is a chemical protection garment, or protective motorcycle clothing respectively.) so that means for cooling the wearer needs to be provided to minimise potential heat stress and discomfort experienced by the wearer. The patent application US 2006/0026743 describes a garment for cooling the body of a wearer, which comprises a substantially gas-impermeable outer shell and a gas-permeable inner shell spaced therefrom so as to form a cavity. A fan is provided for forcing air into the cavity, so that it passes through the inner shell and cools the body of the wearer by means of evaporation of the moisture on the skin of the wearer.

Patent application GB 2362803 discloses a temperature regulated garment, which includes both heating and cooling elements (which are in the form of Peltier thermoelectric devices). A cooling device is located in the collar of the garment; whilst heating elements are located in the front and rear of the garment.

Patent specification U.S. Pat. No. 7,089,995 describes a thermodynamically efficient garment for cooling and/or heating the human body, where a heat exchange fluid (e.g. water) is circulated between particular chosen areas of the body. The fluid may be electrically heated.

It is an object of preferred embodiments of the present invention to provide an improved breathable garment which is provided with both cooling and heating means, which may be controlled by the wearer as appropriate to control his/her body temperature according to the weather conditions and user's activity, being able to be switched on/off and between heat and cool when wearing, with an enhanced performance in motorcycling stamina or endurance, which can be comfortably worn without representing an additional weight for the user, and resulting unobstrusive to wear by leaving just a small footprint on the users.

DISCLOSURE OF THE INVENTION

The present invention provides a breathable garment for heating or cooling independently the body of a wearer. In essence, the breathable garment is characterized in that it comprises:

- an inner electrically heatable substrate intended to be facing the body of the wearer in use;
- forced air supply means for supplying forced air into the space between the electrically heatable substrate and the body of the wearer;
- an intermediate perforated substrate;
- an outer waterproof, water-vapour-permeable substrate; and
- a means for maintaining a gap between the intermediate perforated substrate and the outer substrate, making up an air chamber to allow turbulent airflow across the entire garment.

It is an important feature of the present invention that the electrical heating be provided in the form of an electrically heatable perforated or discontinuous substrate which is intended to be facing the body of the wearer. It has been found that the provision of an electrically heated substrate is advantageous in a number of respects. Firstly, the proximate contact between the heatable substrate and the body of the wearer gives the body of the wearer a very quick sense of being heated. This has been found to be particularly beneficial. It has been found better to provide the heat import in the form of a heated substrate than, for example, by providing a heat source within the airflow within the garment. Heating by raising the temperature of the forced air has been found to be less effective in both heating the wearer and also in providing the sensation of heat without compromising the efficiency, weight and bulk of the complete system. Moreover, the provision of a heat source within the circulating air is likely to constitute a safety issue. Providing an incandescent heat source (for example in the manner of a hairdryer) requires the use of a heat source heated to a high temperature which constitutes a safety issue. Moreover, it has been found that more power is required if heating is provided in this way.

The use of an electrically heatable perforated (or discontinuous) substrate according to the present invention allows a minimum of electrical power to be consumed whilst at the same time providing safety and a good sensation of heat to the wearer. Also, direct heating in this manner allows a quicker response time so that the wearer feels warmer more quickly.

The electrically heatable substrate may be supplied in a frame-like form or may be provided with perforations, so that forced air from the cavity is able to pass through the heatable substrate and directly impinge against the body of the wearer. Also, water vapour is allowed to escape through the substrate. The body of the wearer may, of course, be provided with other clothing, such a T-shirt or other normal inner clothing.

The construction of the electrically heatable layer will generally be chosen so as not to detract too seriously from the overall moisture vapour permeability of the garment. Thus, the electrically heatable substrate preferably includes perforations which take up 40-80% (e.g. 50-70%) of the area of the heated substrate so as to allow passage of airflow to the skin of the wearer. The perforations are usually 5 to 20 mm, especially 8 to 16 mm, in diameter for good air distribution.

According to another feature of the invention, the electrically heatable substrate itself may be formed of polymer loaded with conductive or semi-conductive particles, or alternatively a textile comprising a semi conductive yarn component capable of being resistively heated with the application of electrical current. Alternatively, the electrically heatable substrate is in the form of an electric blanket construction, wherein a pattern of electrical conductors (e.g. wires) are laid across a fabric, which may be of perforated or open-mesh construction so as to allow airflow through the fabric. A carbon-loaded silicone polymer comprises carbon particles held in a silicone polymer matrix. An electric voltage typically of 2-24 volts is applied to the electrically heatable substrate in order to provide resistive heating of typically 10 to 50 watts (e.g. 15 to 30 watts). It has been found that when the electrical current passes through the heatable substrate the carbon particles tend to move apart on heating and this self-regulates the conductivity and therefore the heat emitted by the heatable substrate. This contributes to the intrinsic safe nature of the invention.

In order to facilitate uniform airflow, in one embodiment the electrically heatable perforated substrate is spaced away from a perforated substrate which forms a cavity with the outer water-vapour-permeable substrate. In this manner, the inner surface of the intermediate perforated substrate may be provided with protrusions, whose height is in the range of 0.5 mm to 10 mm, preferably in the range 1 mm to 5 mm and more preferably in the range 3 mm to 6 mm. Thus, the raised protrusions will define a plurality of channels through which air may circulate. The protrusions may be circular in cross-section, but may also be other suitable cross-sections and are preferably uniformly distributed over the surface of the intermediate perforated substrate. Advantageously, the protrusions may be provided by laying down a pattern of raised dots formed of a polymeric material onto the surface of the intermediate perforated substrate. Analogous protrusions may be provided on an inner surface of the outer water-vapour-permeable substrate.

The forced air supply cavity may be formed between the outer water-vapour-permeable substrate and the intermediate perforated substrate.

The garment will normally be provided with forced air supply means, which may be provided in conventional manner, such as by a fan.

Typically, an airflow rate of 20-100 $l/m^2/s$ (e.g. 40-60 $l/m^2/s$) is employed. This has been found to give good cooling in typical circumstances. The fan circulating the forced air typically generates a pressure of 0.5 to 2 mb (e.g. 0.7 to 2 mb).

The breathable (i.e. water vapour permeable) outer substrate may be a 2-layer or 3-layer construction comprising, for example, an expanded PTFE layer. The waterproof water-vapour-permeable outer substrate might also be a microporous material such as a high molecular weight microporous polyethylene or polypropylene, microporous polyurethanes or polyesters.

The benefit of a water-vapour-permeable material is that perspiration from the wearer's body is allowed to escape from within the garment by passage through the fabric, thus preventing build up of liquid water within the garment and consequent clammy feeling. In order to be considered as water-vapour-permeable, the waterproof breathable substrate should generally have a water-vapour-permeability of at least 1,500, preferably greater than 3,000 and more preferably greater than 4000 $g/m^2/24$ hrs. However, values in excess of 20,000 $g/m^2/24$ hrs are possible with certain materials. The overall water-vapour-permeability of the garment of the present invention will usually be somewhat lower than this (e.g. 5,000-10,000 $g/m^{-2}/24$ hrs).

As mentioned previously, the forced air supply cavity may be formed between the outer waterproof water-vapour-permeable substrate and an inner perforated substrate. In order to maintain a gap there between, either or both of the inner surfaces of the outer substrate and the intermediate perforated substrate may be provided with spacer protrusions as described above.

As required, a conventional perforated liner (e.g. a mesh knit) or an open structure textile may be provided as the innermost substrate of the garment in contact with the wearer. Its construction and type should be selected so that it does not significantly impair the heating or cooling effect of the system.

The garment may either be tethered or untethered. When the garment is tethered, it is adapted to be electrically connected to an external electrical supply, such as to the battery of a motor cycle. If the garment is untethered, then it includes its own electrical power supply and this normally takes the form of a battery (usually a rechargeable battery) which provides electrical power to the forced air supply means. Appropriate electrical control means may be provided. Usually, a switch is provided for turning the electrically heatable substrate on and off and a further switch is provided for turning on and off the forced air supply means. One or both of these may be provided with means for varying the electrical power fed to the heatable substrate and/or the forced air supply means. Thermostatic control means might also be provided. The garment is not only capable of being heated and cooled, but is also moisture vapour permeable to allow the exit of excess moisture. Such moisture is able to leave the garment, whether or not the heating and forced air supply means are operative. Perforations in the electrically heatable substrate and the intermediate perforated substrate, allow moisture to pass towards the outside of the garment and ultimately to pass through the outer waterproof water-vapour-permeable substrate. This happens irrespective of whether the heating is on or whether the cavity is inflated due to the air supply means.

The waterproof breathable garment may include jackets, anoraks, trousers etc. It may also be used for bivvy bags (which are waterproof sleeping bags). The garment is particularly useful for motorcycling, where heating may be required when the rider is riding the motor bike in colder climatic conditions, to counteract the effects of wind chill.

However, once the rider dismounts and, for example, enters a heated building, it then becomes necessary to turn off the heating means and to turn on the forced air cooling means. In this way, the wearer can remain at a comfortable temperature independent of the outside ambient conditions. There is no need for the wearer to take off or unzip the garment. In another scenario where the wearer is in a warmer climatic environment and engaged in high aerobic motorcycling activity, the cooling function of the system may be utilised to keep the wearer cool whilst still allowing the wearer to wear his/her protective outer clothing.

DESCRIPTION OF THE DRAWINGS

The attached drawings illustrate a preferred embodiment of the breathable garment object of the present invention by way of a non-limiting example.

DETAILED DESCRIPTION OF THE DRAWINGS

Figure 1:
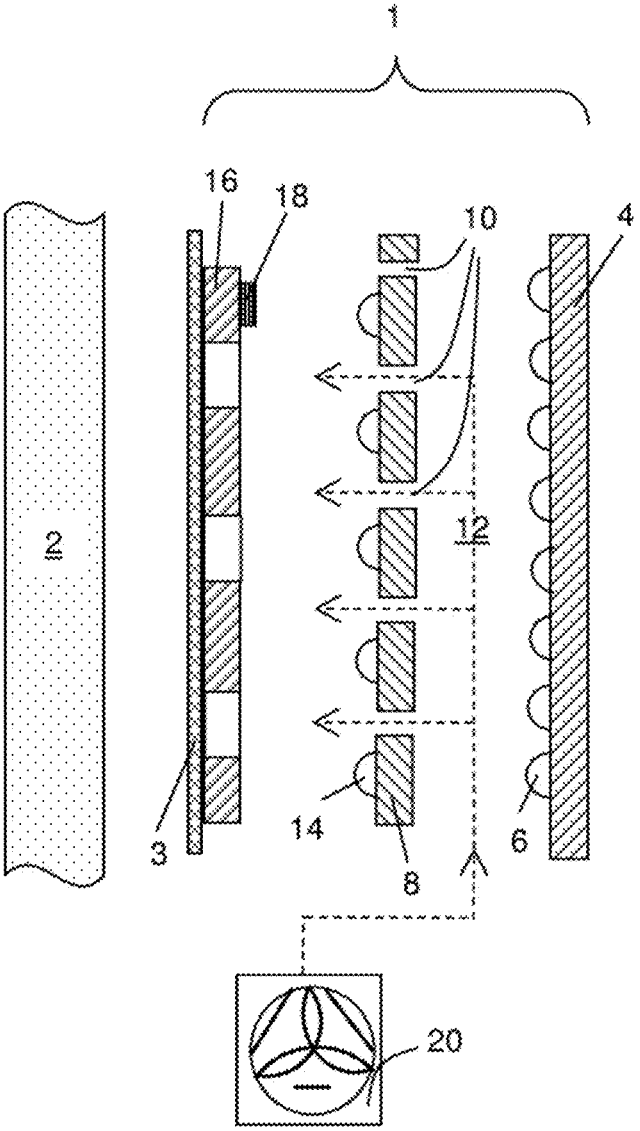
FIG. 1 shows a schematic cross-section of the breathable garment according to the present invention.
Figure 2:
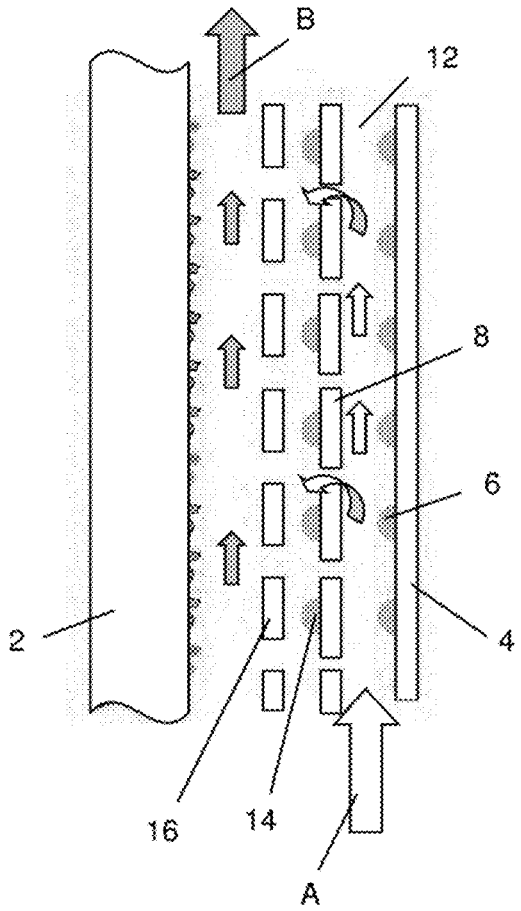
FIGS. 2 and 3 show the breathable garment of FIG. 1 in a cooling mode and a heating mode, respectively.
Figure 3:
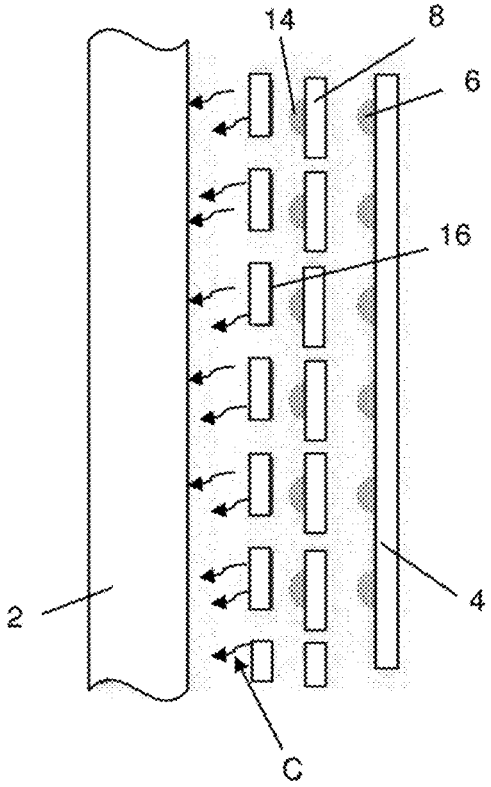

FIG. 1 shows schematically a cross-section showing the construction of the breathable garment 1 for heating (see FIG. 3) or cooling (see FIG. 2) independently the body 2 of a wearer. As is conventional, a lightweight mesh knit liner 3, may be provided for comfort on the inner surface of the garment construction. The breathable garment 1 comprises an outer waterproof water-vapour-permeable substrate 4, having spacer raised protrusions 6 on an inner surface thereof. An intermediate perforated substrate 8 is spaced inwardly towards the wearer from the outer substrate 4 and includes perforations 10. The intermediate perforated substrate 8 defines a forced air supply cavity, the air chamber 12, into which air under pressure is introduced by means of a fan 20. The air enters the forced air supply cavity and is then distributed towards the body 2 of the wearer through the perforations 10. The inner face of the inner perforated substrate 8 also includes spacer protrusions 14. An electrically heatable perforated substrate 16 is spaced inwardly from the intermediate perforated substrate 8 and is provided with heating means (not shown) connected by wire 18 for supplying electrical power to the heatable perforated substrate 16. The perforations in the electrically heatable substrate 16 allow the air supplied from the forced air supply cavity, the air chamber 12, to impinge in a roughly perpendicular direction onto the skin of the body 2 wearer in a uniform distribution.

In use, when heating is desired (FIG. 3), electrical power is provided to the electrically heatable perforated substrate 16 which is adjacent the body 2 and provides an immediate sensation of heat. At the same time, a low supply of air may also be provided by the fan 20 in order to sweep moist air away from the body 2 of the wearer. When cooling is desired (FIG. 2), the heating means provided in the heatable substrate 16 is switched off and the fan 20 is operated to provide a substantial airflow into the force air supply cavity 12 and then through the heatable perforated substrate 16 and onto the body 2 of the wearer. This forced air provides an immediate sensation of cooling to the wearer. Both the heating and cooling devices are operated via electrical control means (not shown) from one or more battery power sources carried on the breathable garment 1.

The breathable garment 1 provides a personal climate comfort management system for motorcycling with a fast response to the personal user's need because it has a thermal hysteresis on switch lower than 1 min and lower than 3 min on switch off. The user's skin temperature can be reduced or increased in more than 3° C. (within 31-33° C.), RH reduction is greater than 25% and the heart rate reduction may reach values greater than 10 bpm. Moreover, the breathable garment 1 is may be used off bike for up to 2 hours and can be worn with protective outer shell garment.

Figure 4:
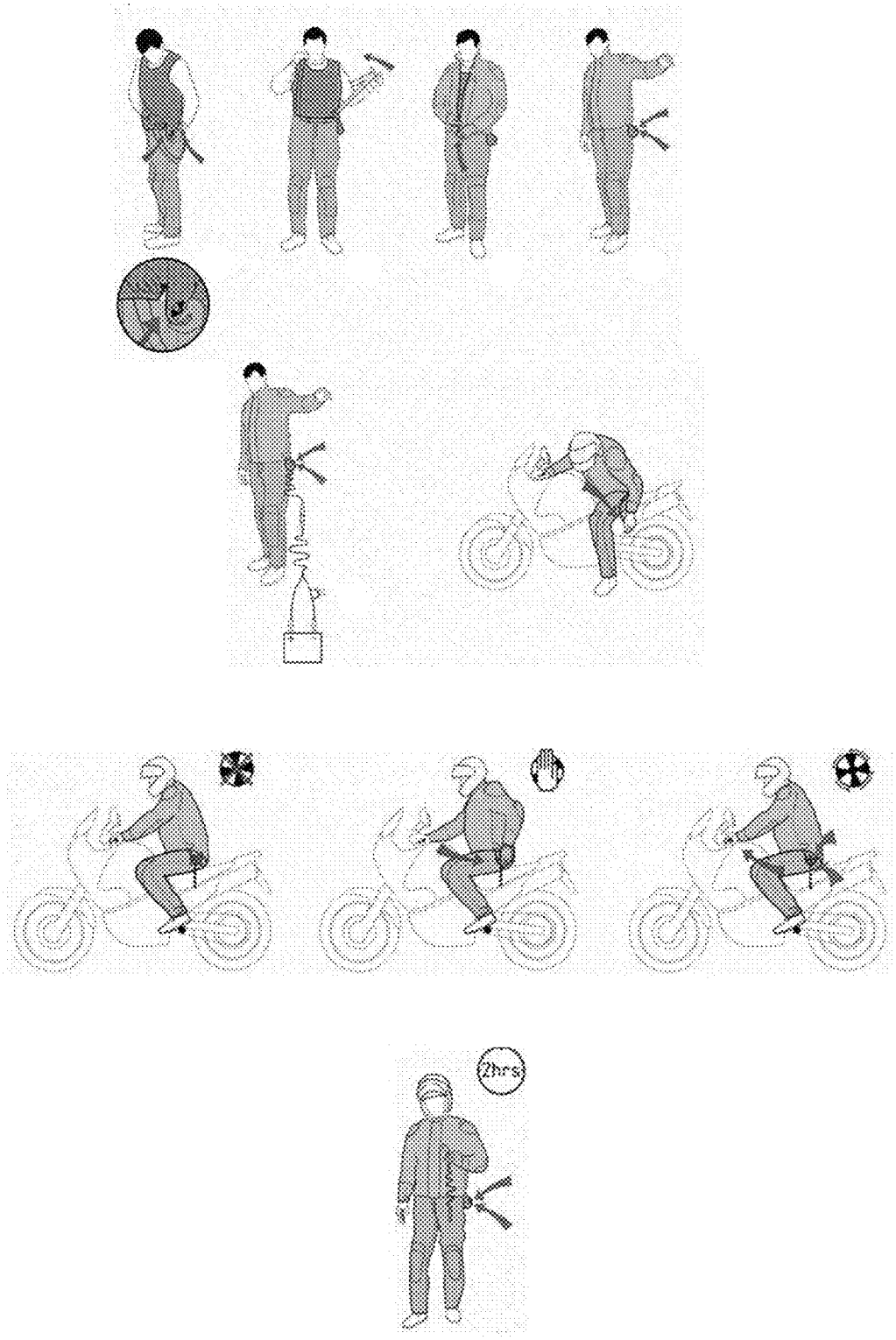
FIG. 4 shows different steps by which the wearer can operate the garment of FIG. 1 in use.

The way of wearing and using the breathable garment 1 is shown in the scenes represented in FIG. 4. As seen in the first four scenes, the breathable garment 1 is worn with normal standard motorcycle ensembles. The fifth and sixth scenes show that the primary power source can be a motorcycle battery. In the following scenes the wearer of the breathable garment 1, that is to say, the rider, activates the heating/cooling of the breathable garment 1 by a control unit strapped to the thigh of the rider and located within easy reach by the left hand. Last scene shows that the breathable garment 1 can also be used in un-tethered cooling mode, wherein power is supplied for 2 hrs by a rechargeable lithium-ion battery.

The invention claimed is:

1. A breathable garment for heating or cooling independently the body of a wearer, comprising:

an inner electrically heatable substrate intended to be facing the body of the wearer in use;

forced air supply means for supplying forced air into the space between the inner electrically heatable substrate and the body of the wearer;

an intermediate perforated substrate;

an outer waterproof, water-vapour-permeable substrate; and a means for maintaining a gap between the intermediate perforated substrate and the outer substrate, making up an air chamber to allow turbulent airflow across the entire garment.

2. The breathable garment according to claim 1, wherein the inner electrically heatable substrate is a perforated layer wherein the surface of the perforations is comprised between 40% and 80% of the total surface to allow passage of airflow to the body of the wearer.

3. The breathable garment according to claim 2, wherein the surface of the perforations in the inner electrically heatable substrate is comprised between 50% and 70% of the total surface.

4. The breathable garment according to claim 2, wherein the diameter of the perforations is comprised between 5 and 20 mm.

5. The breathable garment according to claim 4, wherein the diameter of the perforations is comprised between 8 and 16 mm.

6. The breathable garment according to claim 1, wherein the inner electrically heatable substrate is made of a polymer loaded with conductive or semi-conductive particles.

7. The breathable garment according to claim 6, wherein the inner electrically heatable substrate is made of a carbon-loaded silicone polymer, comprising carbon particles held in a silicone polymer matrix.

8. The breathable garment according to claim 7, wherein the resistive heating provided by the inner electrically heatable substrate is comprised between 10 and 50 watts when an electric voltage between 2 and 24 V is applied thereto.

9. The breathable garment according to claim 1, wherein the inner electrically heatable substrate is a textile comprising a semi-conductive yarn component capable of being resistively heated with the application of electrical current.

10. The breathable garment according to claim 1, wherein the inner electrically heatable substrate is a fabric provided with a pattern of electrical conductors laid across, with a perforate or open-mesh configuration so as to allow airflow through the fabric.

11. The breathable garment according to claim 1, wherein the intermediate perforated substrate is spaced from the inner electrically heatable substrate.

12. The breathable garment according to claim 11, wherein the intermediate perforated substrate comprises a plurality of raised protrusions on the surface facing the inner electrically heatable substrate, the raised protrusions having a height in the range of 0.5 to 10 mm.

13. The breathable garment according to claim 12, wherein the height of the protrusions is in the range of 3 to 6 mm.

14. The breathable garment according to claim 12, wherein the protrusions are made of a polymeric material.

15. The breathable garment according to claim 1, wherein the outer waterproof, water-vapour-permeable substrate comprises a plurality of raised protrusions on the surface facing the intermediate perforated substrate, the protrusions having a height in the range of 0.5 to 10 mm.

16. The breathable garment according to claim 15, wherein the height of the protrusions of the outer substrate is in the range of 3 to 6 mm.

17. The breathable garment according to claim 15, wherein the protrusions of the outer substrate are made of a polymeric material.

18. The breathable garment according to claim 12, wherein the intermediate perforated substrate comprises a further plurality of raised protrusions on the surface facing the outer waterproof, water-vapor-permeable substrate, said protrusions being configured in the same way as the raised protrusions provided on the surface of the intermediate perforated substrate facing the inner electrically heatable substrate.

19. The breathable garment according to claim 1, wherein the outer waterproof, water-vapour-permeable substrate has a water-vapour-permeability of at least 1,500 $g/m^2/24$ hrs and lower than 20,000 $g/m^2/24$ hrs.

20. The breathable garment according to claim 19, wherein the outer waterproof, water-vapour-permeable substrate is a 2-layer or 3-layer substrate, wherein one of the layers is a PTFE layer.

21. The breathable garment according to claim 19, wherein the outer waterproof, water-vapour-permeable substrate is made of a microporous material comprised in the group consisting of a high molecular weight microporous polyethylene or polypropylene, microporous polyurethanes or polyesters.

22. The breathable garment according to claim 1, wherein the forced air supply means provides an airflow rate comprised between 20 and $1001/m^2/s$.

23. The breathable garment according to claim 1, wherein a perforated liner is provided between the inner electrically heatable substrate and the body of the wearer in use, said perforated liner intended to be in contact with the wearer in use.

24. The breathable garment according to claim 1, provided with means to be electrically connected to an external electrical supply.

25. The breathable garment according to claim 1, comprising an electrical power supply which provides electrical power to the forced air supply means.

26. The breathable garment according to claim 25, wherein the electrical power supply is a rechargeable battery.

27. The breathable garment according to claim 1, comprising a wearer operable switch for turning the inner electrically heatable substrate on and off and a further wearer operable switch for turning on and off the forced air supply means.

28. The breathable garment according to claim 1, comprising a switch with a thermal hysteresis on switch on and a thermal hysteresis on switch off for managing climate comfort of the wearer.

29. The breathable garment according to claim 1, wherein the inner electrically heatable substrate is provided with an open structure textile facing the body of the wearer in use.

30. The breathable garment according to claim 1, wherein the outer waterproof, water-vapour-permeable substrate has a water-vapour-permeability of between 5,000 and 10,000 $g/m^2/24$ hrs.

* * * * *